US007913740B2

(12) United States Patent
Chen

(10) Patent No.: US 7,913,740 B2
(45) Date of Patent: Mar. 29, 2011

(54) THREE DIMENSIONAL SHADE

(76) Inventor: A-Nan Chen, Luh-Gaang Chen (TW)

( * ) Notice: Subject to any disclaimer, the term of this patent is extended or adjusted under 35 U.S.C. 154(b) by 108 days.

(21) Appl. No.: 11/902,519

(22) Filed: Sep. 21, 2007

(65) Prior Publication Data

US 2010/0269986 A1 Oct. 28, 2010

(51) Int. Cl.
*E06B 9/386* (2006.01)

(52) U.S. Cl. ..... 160/168.1 V; 160/178.1 V; 160/236; 160/352; 16/87.2

(58) Field of Classification Search ..... 160/352, 160/236, 348, 199, 178.1 V, 168.1 V, 176.1 V; 16/87.2

See application file for complete search history.

(56) References Cited

U.S. PATENT DOCUMENTS

| | | | | | |
|---|---|---|---|---|---|
| 661,608 | A * | 11/1900 | Holtzclaw | 160/84.01 |
| 2,197,478 | A * | 4/1940 | Mathieu | 135/147 |
| 2,996,116 | A * | 8/1961 | Hudson | 160/348 |
| 3,645,318 | A * | 2/1972 | Holzlehner | 160/348 |
| 3,807,482 | A * | 4/1974 | Baker, Sr. | 160/330 |
| 5,908,179 | A * | 6/1999 | Fimbres | 248/51 |
| 2008/0099164 | A1 * | 5/2008 | Filipiak et al. | 160/236 |

* cited by examiner

*Primary Examiner* — Blair M. Johnson
(74) *Attorney, Agent, or Firm* — Guice Patents PLLC

(57) ABSTRACT

A three dimensional shade to provide a three dimensional layer structure and profile includes a movable frame and a shade. The movable frame is installed on any two sliding docks movable on a track of a upper beam. The movable frame includes at least two coupling plates that are hinged together to hang the shade. A drawing element is provided to draw and perform retraction and extension operations so that the shade can be retracted and extended to form a profile same as the movable frame to achieve the three dimensional effect.

7 Claims, 8 Drawing Sheets

THREE DIMENSIONAL SHADE

BACKGROUND OF THE INVENTION

1. Field of the Invention

The present invention relates to a three dimensional shade and particularly to a three dimensional shade that provides a three dimensional layer structure and profile to enhance added value in use.

2. Description of the Prior Art

Refer to FIGS. 1 and 2 for embodiments of conventional window shades 1 and 2. They are simple and practical. By cooperating with different materials and patterns, they also can be matched with overall interior design and color configuration to enhance aesthetic appeal. However these days the window shade has evolved from the simple masking function in the past to become an important element of the overall interior design. While altering the pattern or color can enhance the aesthetic appeal, the structure still is formed in a simple plane fashion, and does not provide three dimensional visual effect and layer structures.

SUMMARY OF THE INVENTION

In view of the aforesaid concerns, the present invention aims to provide a three dimensional shade that provides a three dimensional layer profile to enhance added value when in use.

To achieve the foregoing object, the invention includes a movable frame and a shade. The movable frame is installed on any two sliding docks movable on a track of a upper beam and can be drawn by a drawing element to retract and extend.

The movable frame has at least two coupling plates hinged together. Each of the coupling plates has two ends with a first hinge mechanism and a second hinge mechanism located thereon to allow two neighboring coupling plates to be coupled together to form a movable joint. The movable frame also has at least two clip fastening portions corresponding to the coupling plates to clip and fasten the sliding docks. Each of the coupling plates has at least one first anchor element.

The shade has at least one second anchor element at a top portion to couple with the first anchor element to hang the shade.

In one aspect the first anchor element is a hook.

In another aspect the second anchor element is an aperture.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
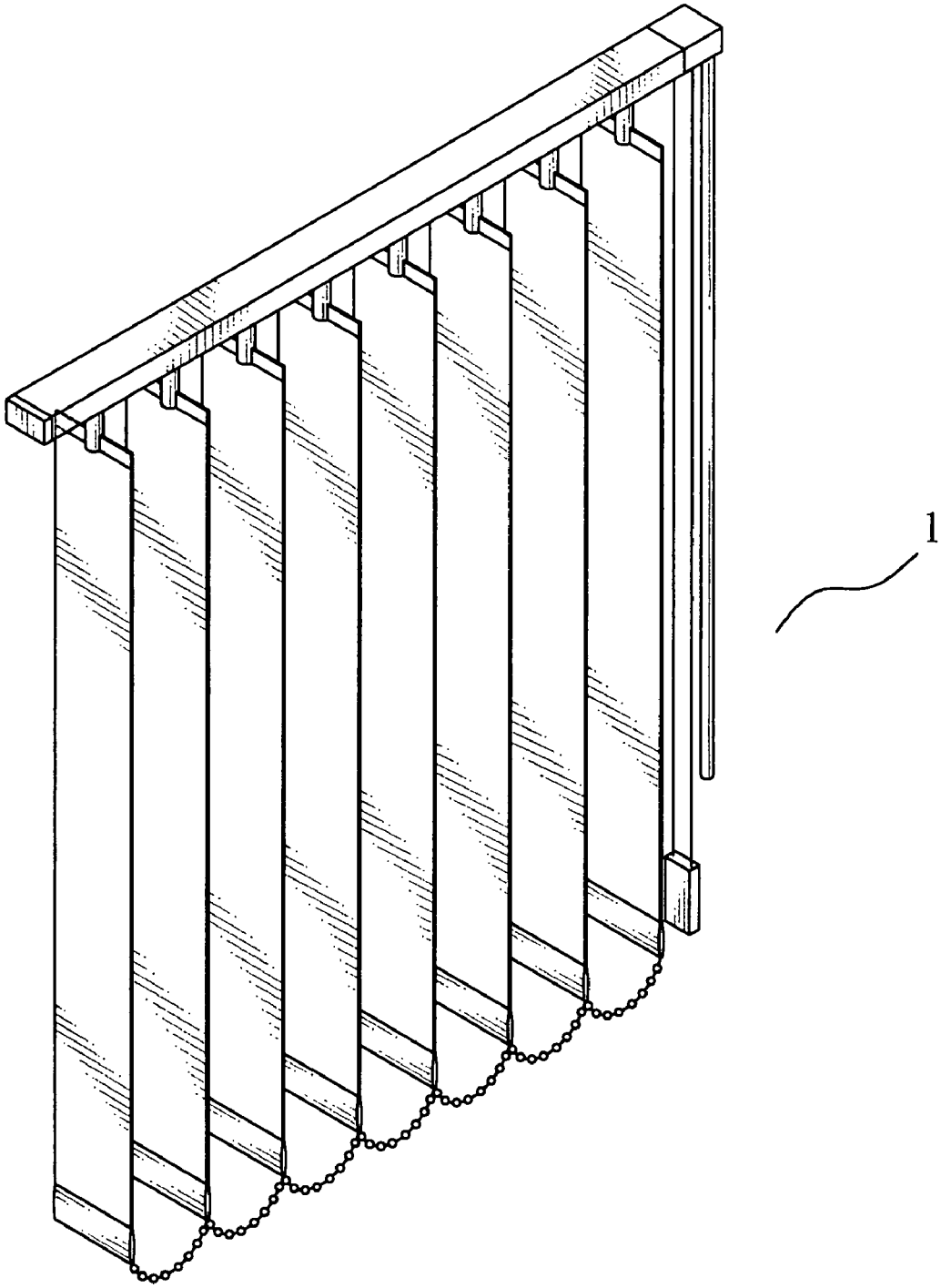
FIG. 1 PRIOR ART
FIG. 1 is a schematic view of an embodiment of a conventional window shade.
Figure 2:
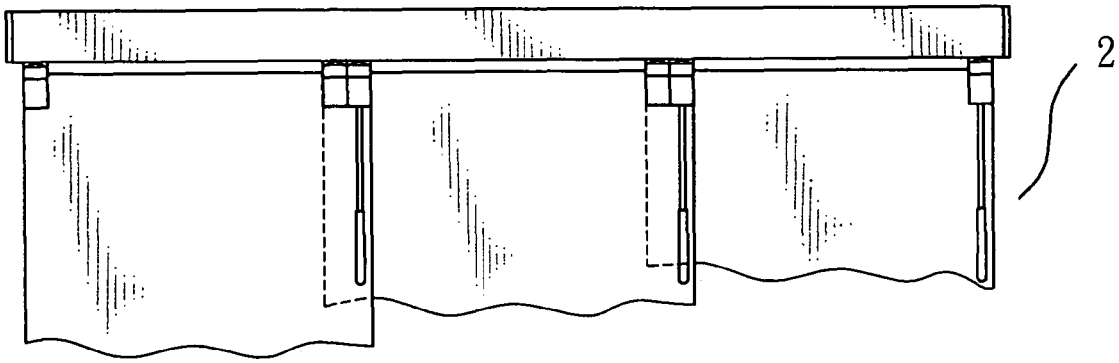
FIG. 2 PRIOR ART
FIG. 2 is a schematic view of another embodiment of a conventional window shade.
Figure 3:
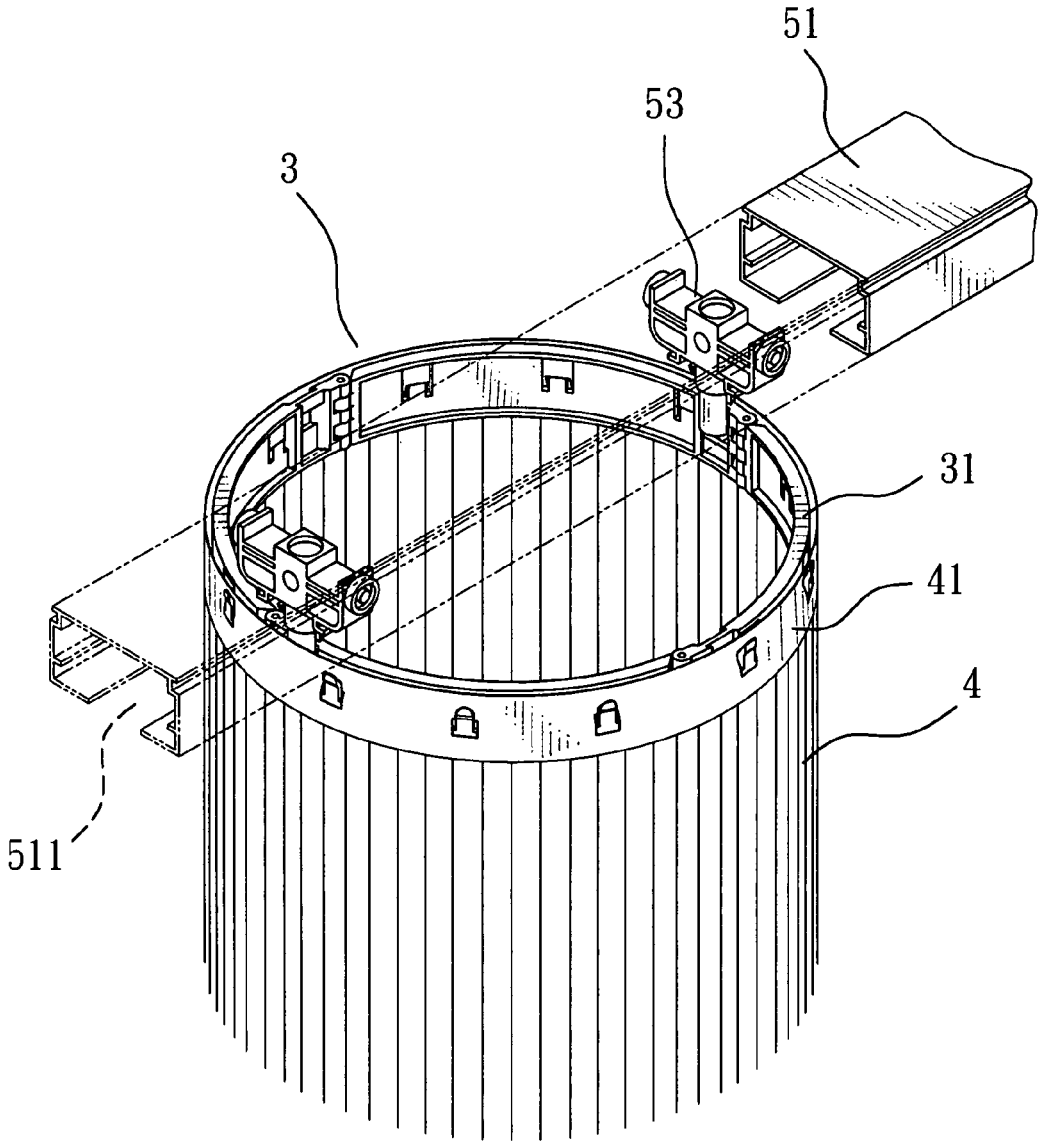
FIG. 3 is a perspective view of the invention.
Figure 4:
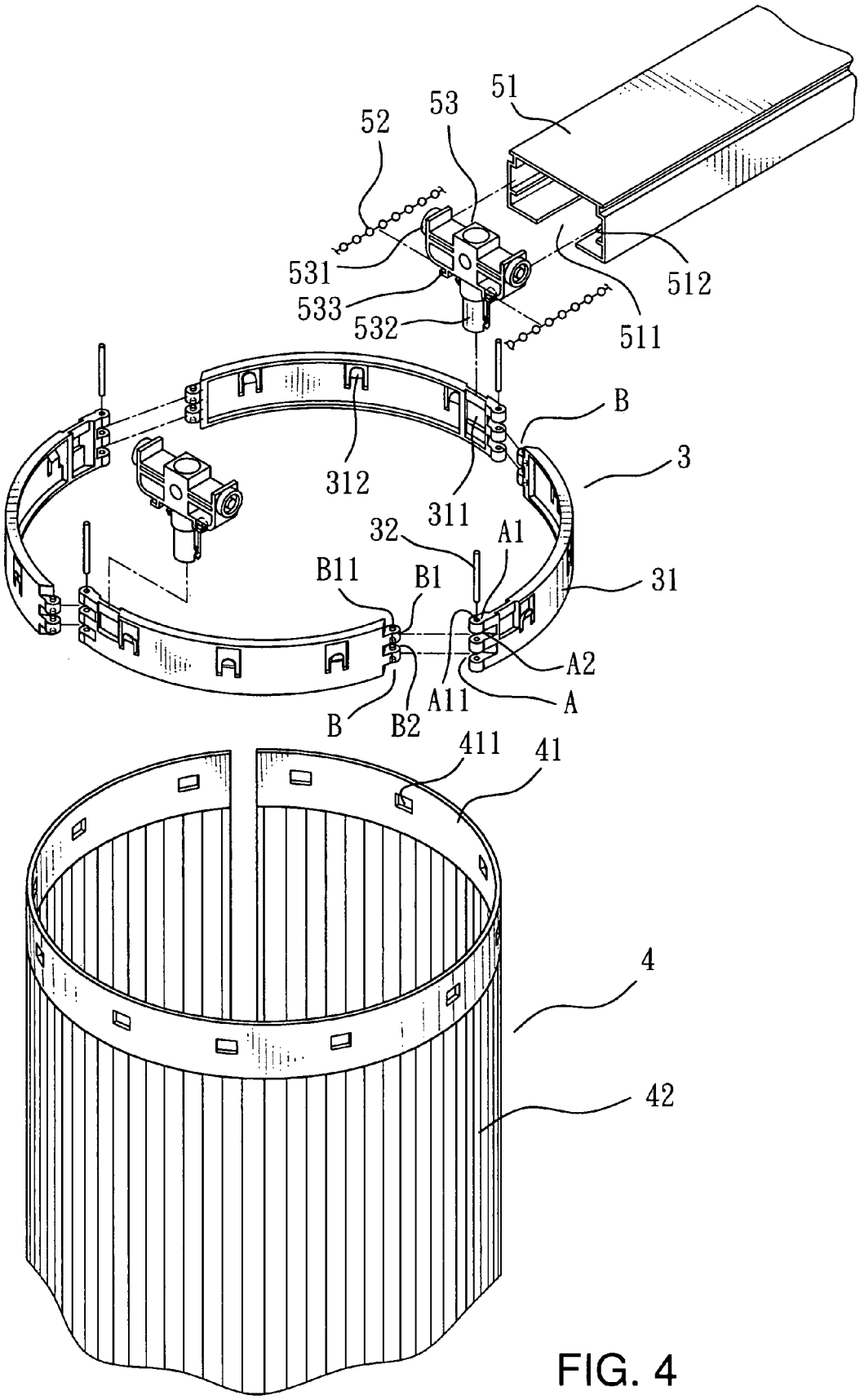
FIG. 4 is an exploded view of the invention.
Figure 5:
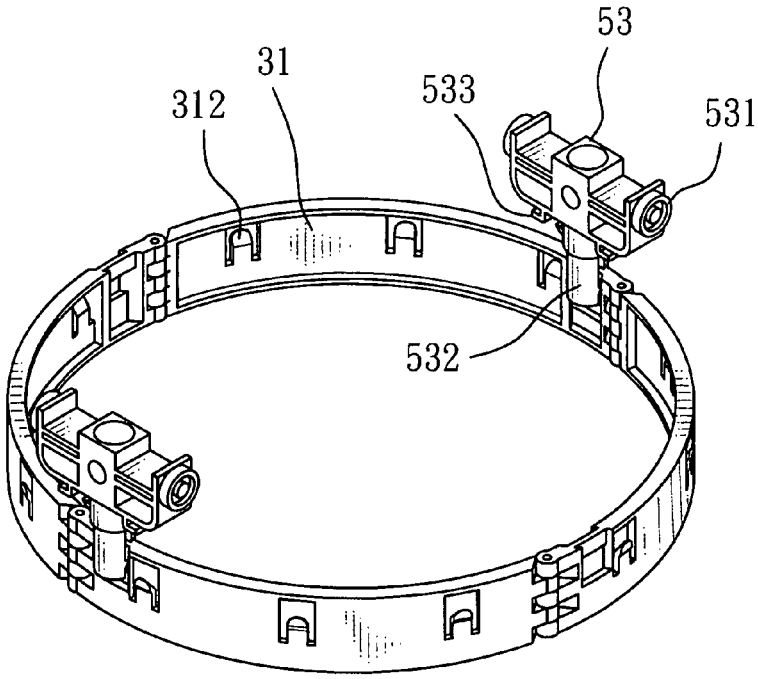
FIG. 5 is a perspective view of the movable frame of the invention.

Referring to FIGS. 3 through 6, the three dimensional shade according to the invention includes a movable frame 3 and a shade 4. The movable frame 3 is installed on any two sliding docks 53 movable on a track 512 of a upper beam 51 and can be drawn by a drawing element 52 to retract and extend.

The movable frame 3 has at least two coupling plates 31 hinged together. Each of the coupling plates 31 has two ends with a first hinge mechanism A and a second hinge mechanism B located thereon to allow two neighboring coupling plates 31 to be coupled together to form a movable joint C. The movable frame 3 also has at least two clip fastening portions 311 corresponding to two coupling plates 31 to clip and fasten the sliding docks 53. Each of the coupling plates 31 has at least one first anchor element 312.

The shade 4 has at least one second anchor element 411 at a top portion 41 to couple with the first anchor element 312 to hang the shade 4.

The sliding dock 53 has two sides which have respectively at least one wheel 531 located thereon to be rested on the track 512 of the upper beam 51 so that the sliding dock 53 can slide on the upper beam 51. The sliding dock 53 further has a clip portion 532 at a lower side that is extended through an opening 511 of the upper beam 51. The clip portion 532 has two sides each has a retaining rib 533 formed thereon.

The drawing element 52 is a bead chain or drawing rope to be fastened to the sliding dock 53 to allow users to draw the sliding dock 53 to retract and extend the shade 4.

Figure 7:
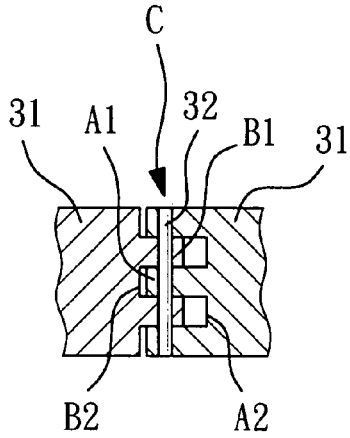
FIG. 7 is a fragmentary sectional view of the movable joint of the invention.
Figure 6:
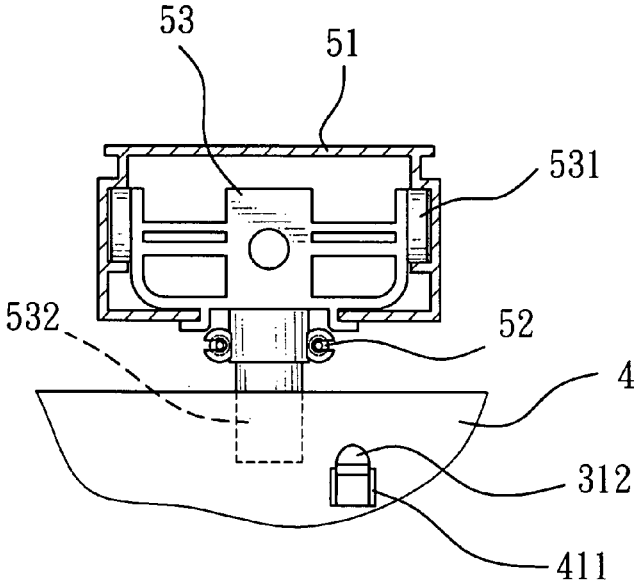
FIG. 6 is a fragmentary sectional view of the invention.

The movable joint C includes the first hinge mechanism A which has at least one first jutting rib A1 and at least one first notch A2 located at one coupling plate 31 and the mating second hinge mechanism B located at a neighboring coupling plate that has at least one second notch B2 and one second jutting rib B1 that are coupled through a pin 32 running through apertures A11 and B11 formed on the first and second jutting ribs A1 and B1 to form a swivel axis (referring to FIG. 7).

Figure 8:
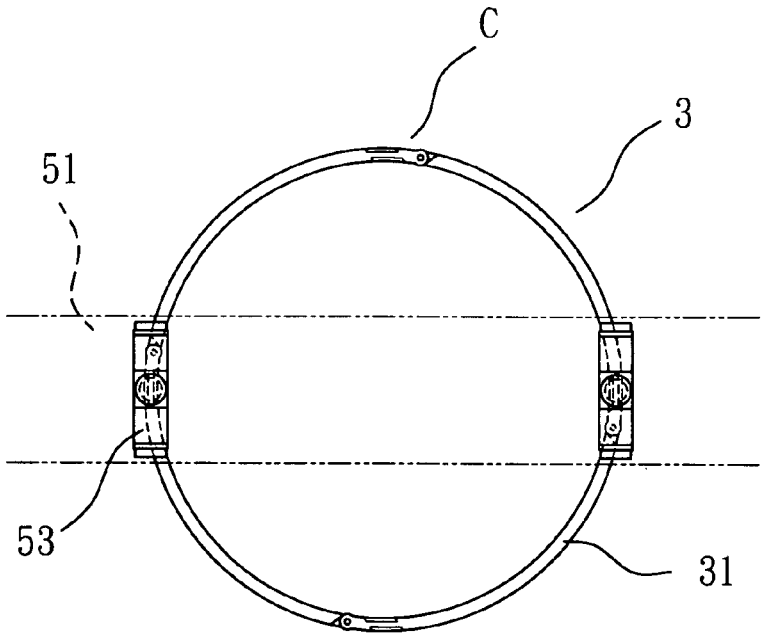
FIG. 8 is a schematic view of the movable frame in an extended condition.
Figure 9:
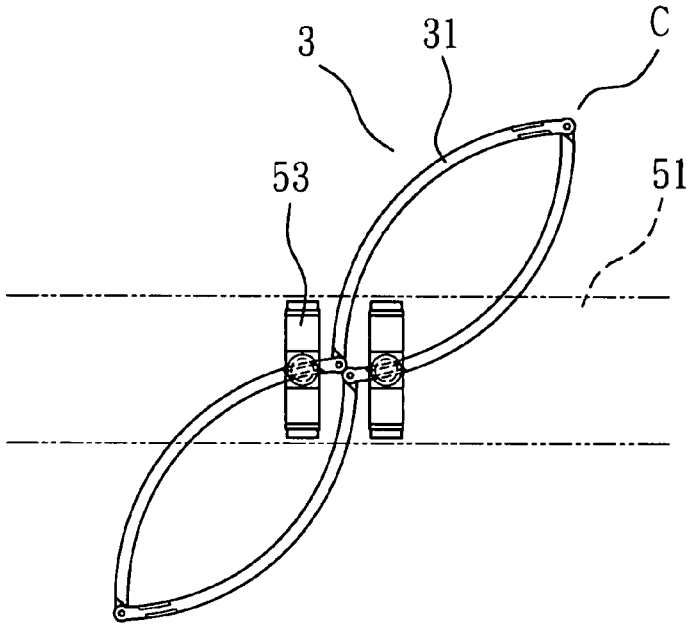
FIG. 9 is a schematic view of the movable frame in a retracted condition.
Figure 10:
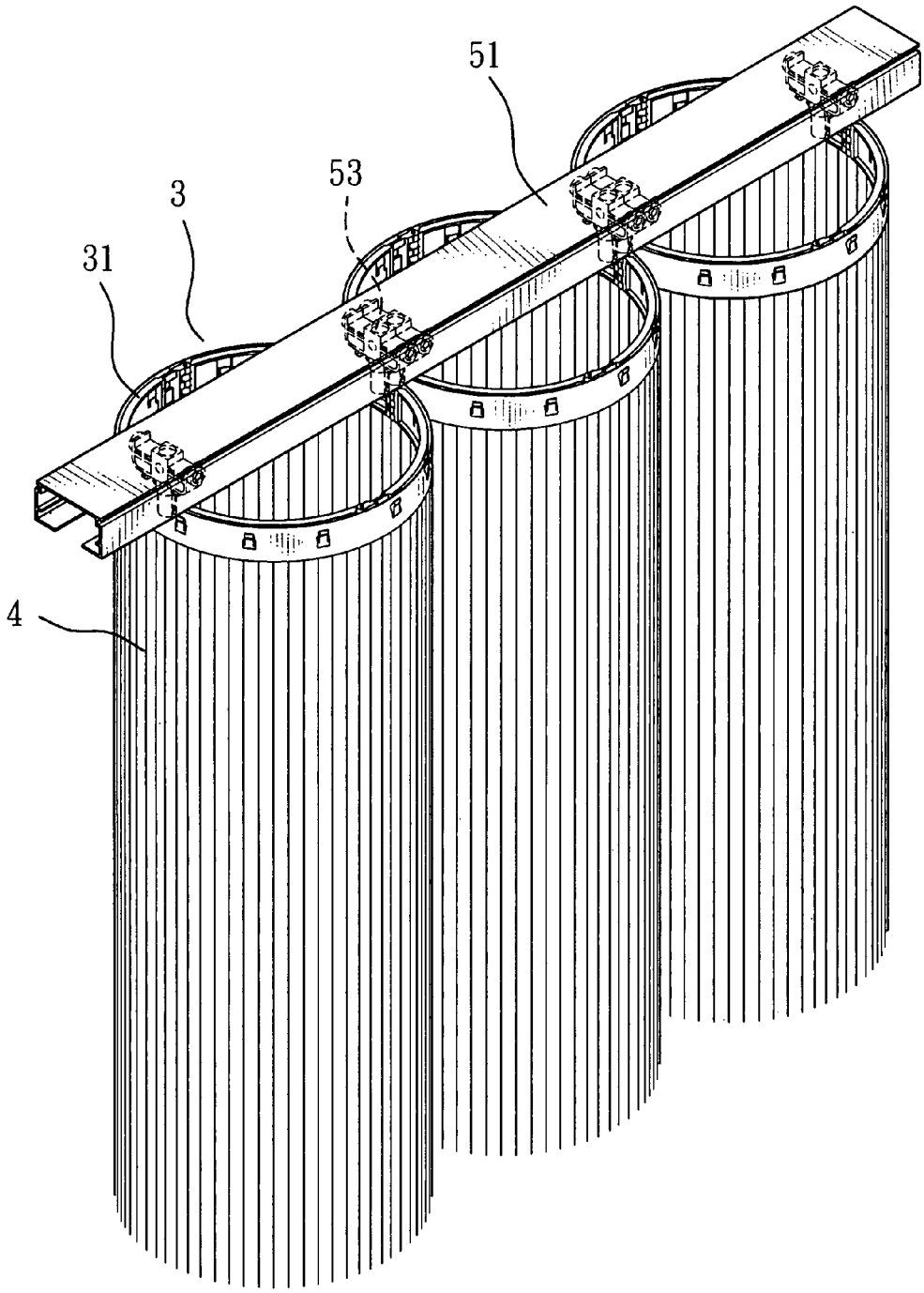
FIG. 10 is a schematic view of an embodiment of the invention.

By means of the construction set forth above, when in use for extending (referring to FIGS. 8 and 10), by drawing the drawing element 52 the sliding dock 53 on the upper beam 51 can be moved to allow the movable frame 3 consisting of a plurality of the coupling plates 31 to form a closed profile in a fully extended condition. The profile of the shade 4 hung on the movable frame 3 can be changed to become a three dimensional layer structure. To retract the shade, move the sliding dock 53 in the reverse direction in the upper beam 51 through the drawing element 52, the coupling plates 31 on the movable frame 3 are bent and retracted inwards about the movable joint C (referring to FIG. 9) so that the movable frame 3 is shrunk to a smaller size, but still maintains the three dimensional profile in another shape. And the shade 4 hung on the movable frame 3 also is changed to another shape according to the corresponding position to form another three dimensional layer profile.

Figure 11:
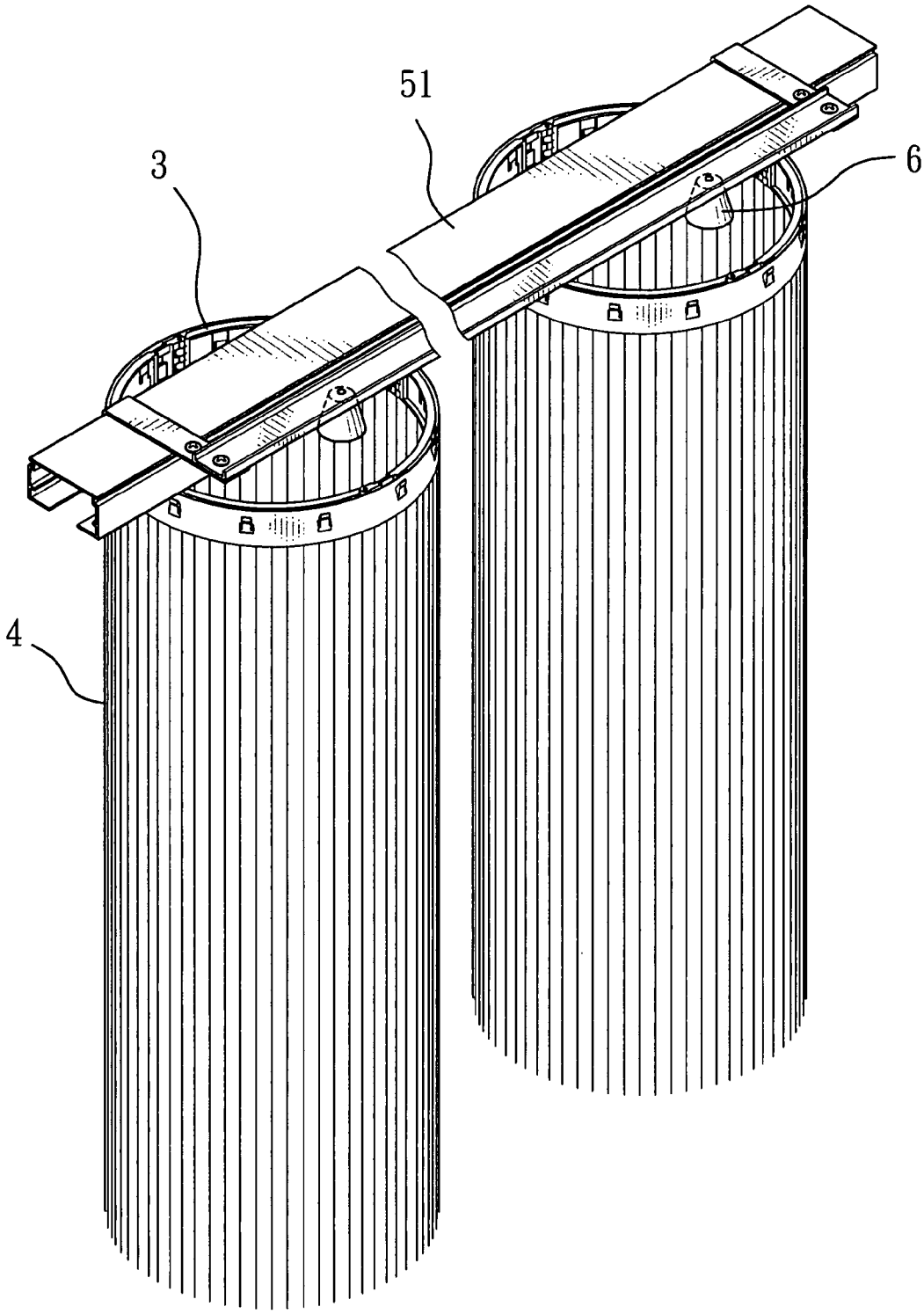
FIG. 11 is a schematic view of another embodiment of the invention.

Referring to FIG. 11, in order to enhance aesthetic appeal at least one lighting fixture 6 may be installed at one side of the upper beam 51. When the lighting fixture 6 is set ON light can project downwards from the upper side of the shade 4 to allow the shade 4 to look like a lamp shade. Thus more aesthetic appeal and added value can be accomplished.

I claim:

1. A three dimensional shade comprising:

a plurality of movable frames and a plurality of shades, each shade of the plurality of shades corresponding to a movable frame of the plurality of movable frames;

each said movable frame having at least two coupling plates and two sliding docks, the at least two coupling plates are hinged together end to end forming a movable joint and defining an outer periphery of the movable frame, each said coupling plate of the at least two coupling plates has a first hinge mechanism located on a first end thereof, a second hinge mechanism located on a second end thereof, and at least one first anchor element, each said first hinge mechanism is connected to a corresponding second hinge mechanism of each of the at least two coupling plates forming the outer periphery of the movable frame, the movable frame has at least two clip fastening portions corresponding to the at least two coupling plates of the movable frame, each of the two sliding docks is connected to a corresponding one of the at least two clip fastening portions, the two sliding docks are slidably connected to a track of a upper beam, and a drawing element selectively moving the plurality of movable frames between an extended position and a retracted position, each of the plurality of movable frames are movable between an open position and a collapsed position; and each shade of the plurality of shades has at least one second anchor element located on a top portion thereof connecting the shade to the first anchor element of a corresponding moveable frame of the plurality of movable frames, each said shade has a cross section corresponding to the outer periphery of the movable frame, wherein the cross section of the shade corresponds to the outer periphery of the movable frame when the movable frame moves between the open position and the collapsed position.

2. The three dimensional shade according to claim 1, further comprising at least one lighting fixture located on the upper beam, the at least one lighting fixture illuminating an interior of a corresponding shade.

3. The three dimensional shade according to claim 1, wherein the clip fastening portion is an aperture.

4. The three dimensional shade according to claim 1, wherein the first anchor element is a hook.

5. The three dimensional shade according to claim 1, wherein the second anchor element is an aperture.

6. The three dimensional shade according to claim 1, wherein the movable joint includes the first hinge mechanism which has at least one first jutting rib and at least one first notch located at one coupling plate and the mating second hinge mechanism located at a neighboring coupling plate that has at least one second notch and one second jutting rib that are coupled through a pin running through apertures formed on the first jutting rib and the second jutting rib to form a swivel axis.

7. The three dimensional shade according to claim 1, wherein, when each said movable frame is located in the open position, the outer periphery of each said movable frame is circular.

* * * * *